United States Patent [19]

Denison

[11] 4,226,116

[45] Oct. 7, 1980

[54] LOGGING WHILE RAISING A DRILL STRING

[75] Inventor: Early B. Denison, Houston, Tex.

[73] Assignee: Shell Oil Company, Houston, Tex.

[21] Appl. No.: 1,798

[22] Filed: Jan. 8, 1979

[51] Int. Cl.[2] ..... E21B 49/00

[52] U.S. Cl. ..... 73/151

[58] Field of Search ..... 73/151, 152; 175/50; 367/81, 82, 86

[56] References Cited

U.S. PATENT DOCUMENTS 3,795,141 3/1974 Planche ..... 73/151

4,056,004 11/1977 Roesner ..... 73/151

*Primary Examiner*—Jerry W. Myracle

[57] ABSTRACT

In logging a well substantially as soon as it is drilled, at least one measuring transducer and a transducer-moving system are mounted within a lower portion of a segmented electrically-conductive drill string. At least one downhole transducer is moved in response to an electrical command and is held near or against the borehole wall while the drill string is raised and a recording is made of electrical signals indicative of both the downhole transducer measurements and the distance the drill string is raised.

10 Claims, 12 Drawing Figures

FIG. 6
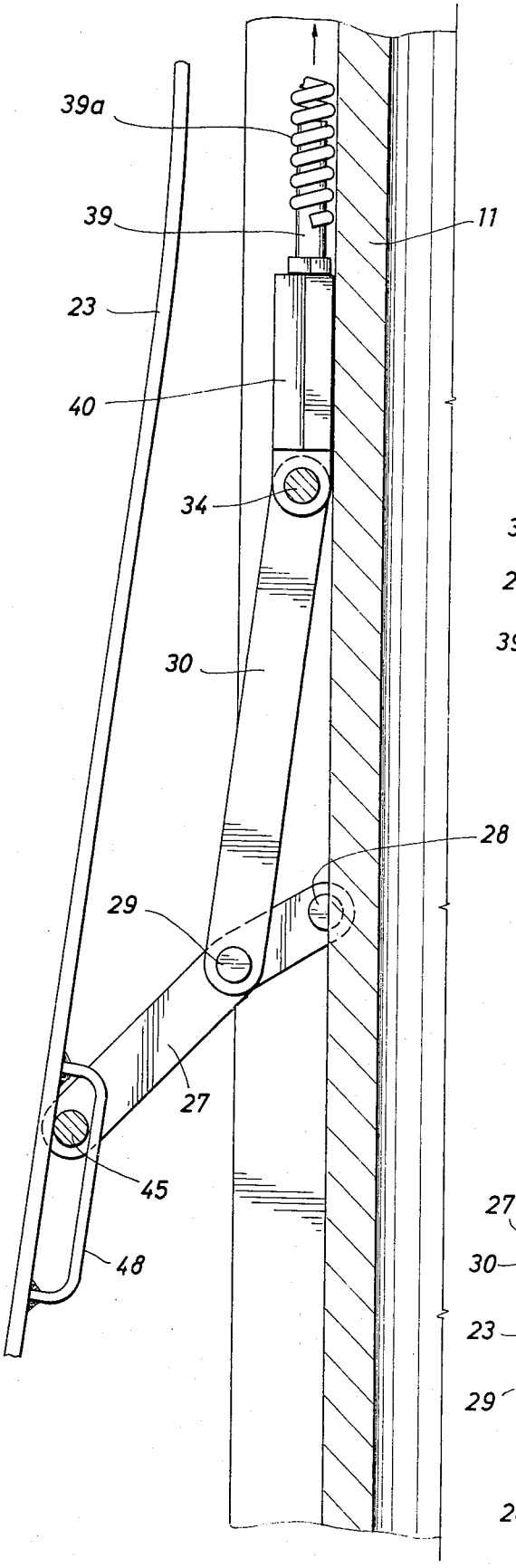
FIG. 7
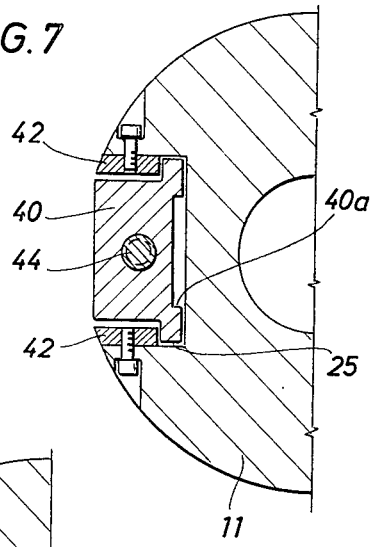
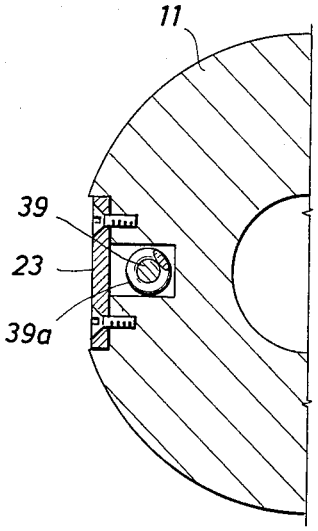
FIG. 8
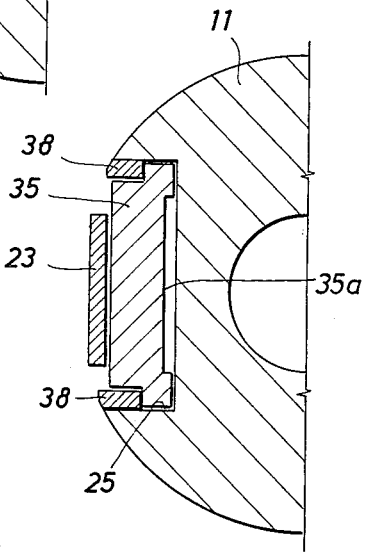
FIG. 9
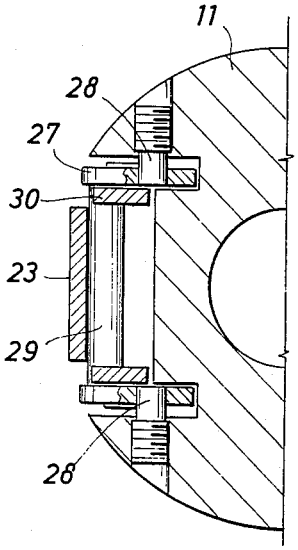
FIG. 10

LOGGING WHILE RAISING A DRILL STRING

BACKGROUND OF THE INVENTION

This invention relates to logging a well substantially as soon as its borehole is drilled. More particularly, the invention relates to drilling a well with a signal-transmissive drill string containing a movably mounted magnitude-responsive transducer, moving that transducer against the borehole wall, raising the drill string while logging properties which are so encountered, then returning the transducer within the external confines of the drill string before the drill string is lowered or removed from the borehole of the well.

The existence of a long-felt need for a means for reliably transmitting electrical signals along a drill string is described in the L. L. Dickson and E. G. Ward U.S. Pat. No. 3,696,332. The patent references numerous prior proposals and describes an improved system that uses an insulated electrical conductor which extends along some or all of the pipe joints of a segmented drill string assembly. An E. B. Denison U.S. Pat. No. 4,126,848, describes particularly suitable embodiments of signal-transmissive drill string assemblies which contain wire lines for transmitting electrical signals from near bottom to intermediate locations and either insulated wire-containing pipe sections or electromagnetic signal-transmitting and receiving means for transmitting electrical signals to and from a sufrace location. A copending patent application by C. B. Vogel and G. T. Worell, Ser. No. 819,806, filed July 28, 1977, now U.S. Pat. No. 4,130,816 relates to a circumferential acoustical detector involving a plurality of cylindrical transducers mounted on movable arms with means for moving them into and out of close proximity with a borehole wall in order to provide an acoustic log capable of detecting the presence of vertical fractures. The disclosures and references contained in the U.S. Pat. Nos. 3,696,332, 4,126,848 and 4,130,816 patents are incorporated herein by reference.

SUMMARY OF THE INVENTION

The present invention relates to drilling a downwardly extending well and logging it without the necessity of removing the drill string from the borehole. The borehole is drilled with a signal-transmissive drill string which contains at least one magnitude-responsive transducer. That transducer is movably mounted within a lower portion of the drill string and is mechanically connected to a command signal-actuatable means for applying a force capable of moving the transducer toward and away from an extended position at least substantially in contact with the borehole wall and a retracted position at least substantially within the external confines of the drill string. While the drill string is stopped, a command signal is transmitted along it to the transducer moving means to actuate the urging of the magnitude-responsive transducer toward its extended position. The drill string is raised while transmitting along it a signal indicative of the magnitude at which a subterranean physical or chemical property is encountered by the magnitude-responsive transducer while it is in contact with, or in close proximity to, the borehole wall. A movement-responsive transducer is employed to provide a signal indicative of the distance by which the drill string is raised and a record is made of the variation with depth in the property encountered by the magnitude-responsive transducer. A command signal is transmitted along the drill string to actuate the urging of the magnitude-responsive transducer toward its retracted position before the drill string is lowered or removed from the borehole.

In a particularly preferred embodiment, the magnitude-responsive transducer is moved into and out of contact with the borehole wall by moving one portion of a resilient linking-means which is mechanically connected between a movement-impairing means and the transducer. The portion of the resilient means which is moved is moved far enough to press the transducer against one side of the borehole when the drill string is pressed against the opposite side. The force which is transmitted by the resilient means to the transducer is sufficient to so move the transducer, when such movement is not prevented by the borehole wall, but is insufficient to move or damage the transducer or the means by which it is moved or mounted when the transducer-containing portion of the drill string is pressed against the wall of the borehole.

In a particular preferred procedure, the logging is accomplished with a minimum of lost time or wasted motion during the drilling operation. The borehole is drilled by operating the drill string to drill about the length of a pipe section, then stopping to add a new pipe section, then resuming the drilling. During at least one such stop, the downhole magnitude-responsive transducer is moved to its extended position, operated to log while the drill string is raised through some or all of the most-recently drilled portion of the borehole, and then returned to its retracted position. Then, after adding the new pipe section and lowering the drill string, the drilling is resumed.

In another preferred embodiment, signal-transmissive drill string is one in which a wireline is used to transmit electrical signals from near the bottom to an intermediate portion of the drill string, above which portion pipe sections containing an interconnected insulated electrical conductor, or an electromagnetic signal-transmitting and receiving means, is used to transmit electrical signals along the drill string assembly (substantially as described in U.S. Pat. No. 4,126,848). In another preferred embodiment, a plurality of movably-mounted cylindrical acoustic transducers are utilized for transmitting and receiving acoustic waves the magnitudes of which are measured (substantially as described in U.S. Pat. No. 4,130,816).

DESCRIPTION OF THE DRAWING

FIG. 6 shows transducer-moving elements of the type shown in FIG. 5 in a transducer-extending position.

FIG. 7 is a cross section along the line 7—7 through the system shown in FIG. 3A.

FIG. 8 is a cross section along the line 8—8 through the system shown in FIG. 3A.

FIG. 9 is a cross section along the line 9—9 through the system shown in FIG. 3B.

FIG. 10 is a cross section along the line 10—10 through the system shown in FIG. 3B.

DESCRIPTION OF THE INVENTION

Figure 1:
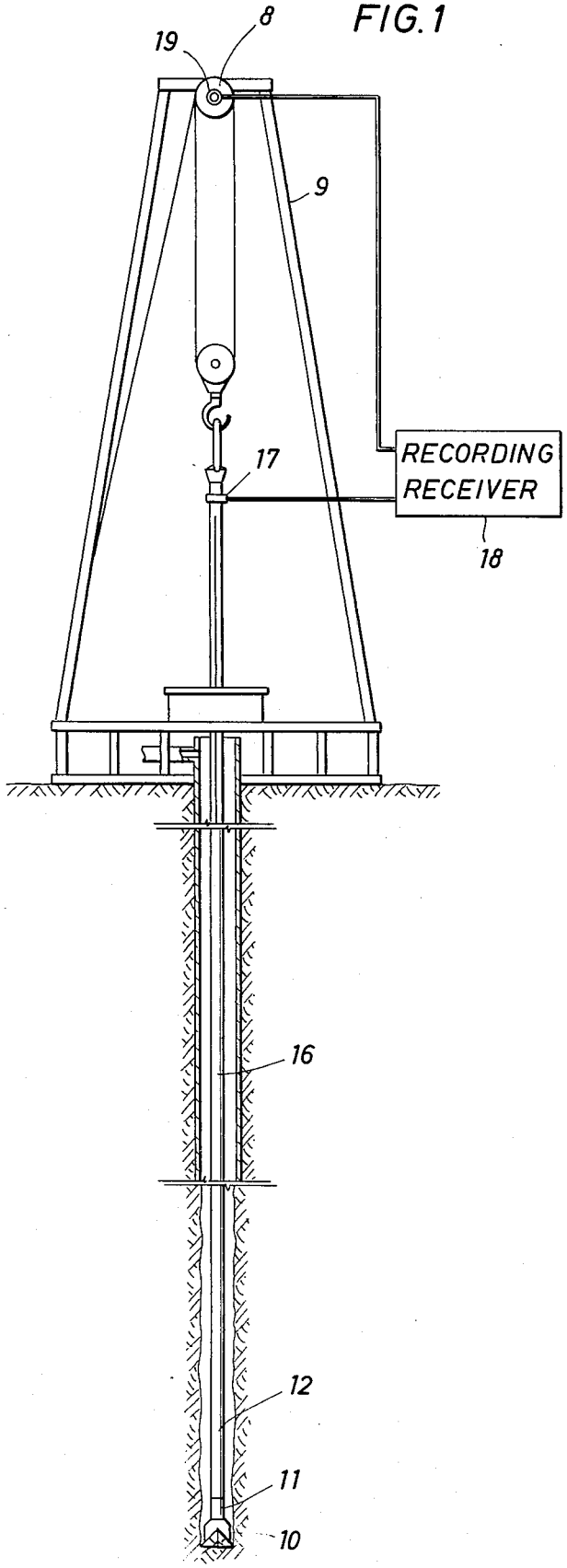
FIG. 1 is a schematic representation of means for operating the present system in a well being drilled.

FIG. 1 shows a drill string suspended from a rig 9 in which the means for raising and lowering the drill string includes a stationary block 8. The drill string includes a drilling bit 10, a drill collar section comprising an instrument package or sub 11 which contains the magnitude-responsive transducer employed in the present invention. A series of weight-imparting drill string collars 12, an electrical signal-conductive drill pipe section 16, and a slip ring assembly 17 are arranged in the illustrated drill string assembly to convey electrical signals along the drill string to and from surface-located electrical devices inclusive of a recording-receiver unit 18. The unit 18 is also arranged to receive an electrical signal indicative of the distance the drill string is raised from a movement-responsive transducer 19 associated with the stationary block of the drilling rig to be responsive to the amount by which the drill string is moved.

Figure 2:
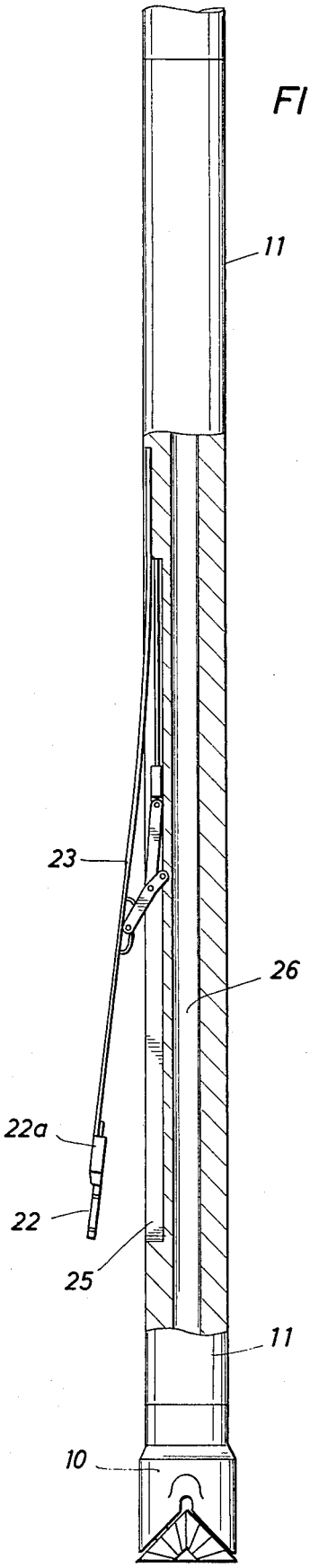
FIG. 2 is a partial vertical section of a magnitude-responsive transducer positioned against a bore-hole wall in accordance with the present invention.

FIG. 2 shows the instrument sub 11 with a measuring transducer 22 mounted on a flexible arm 23. In the position shown the transducer has been moved outside the external confines of the drill string so that the transducer wear pad 22*a* would be pushed into engagement with the wall of a borehole. The dimensions of such a transducer and transducer-mounting arm are preferably such that they can be encompassed within slot 25 and be entirely within the external confines of the drill string. The slot 25 is arranged along the external wall of the instrument sub 11, which sub contains an internal passageway 26 for fluid circulation. As will be apparent to those skilled in the art, one or more additional slots 25 can be similarly arranged on different sides of the instrument sub to provide housings for additional movably-mounted transducers.

Figure 3A:
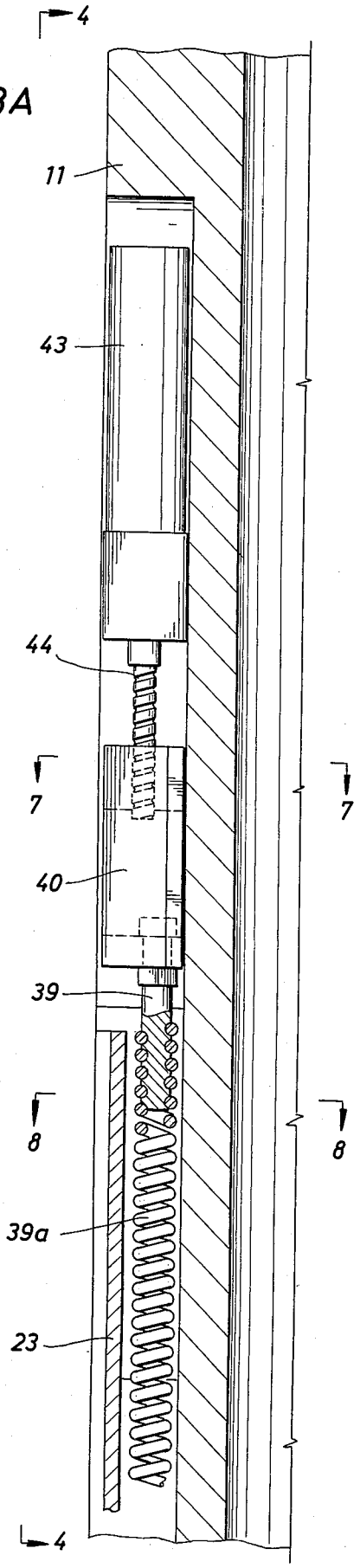
FIGS. 3A and 3B are partial vertical sections of a transducer moving system mounted within the external confines of a collar section of a drill string.
Figure 3B:
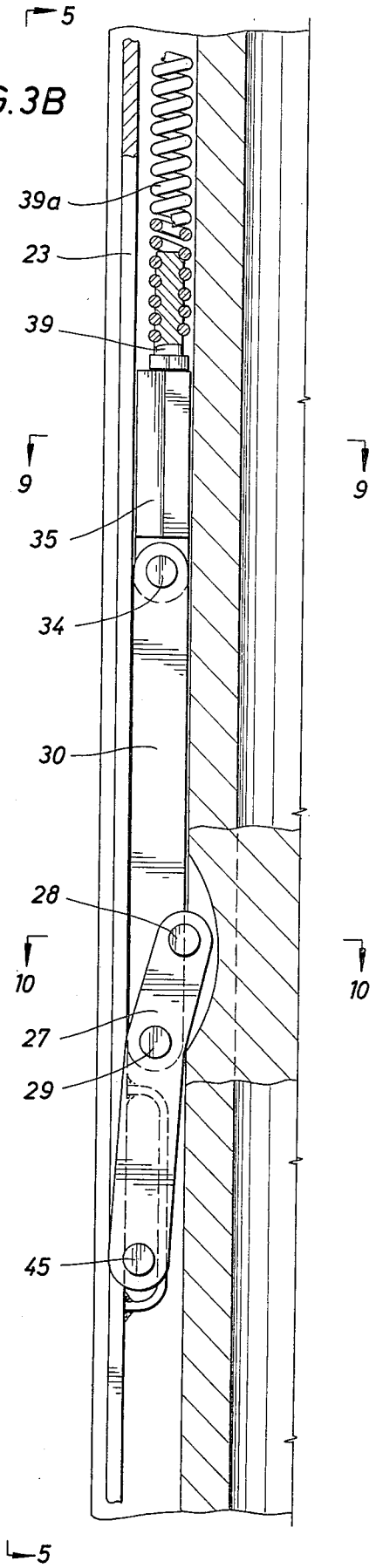
Figure 4:
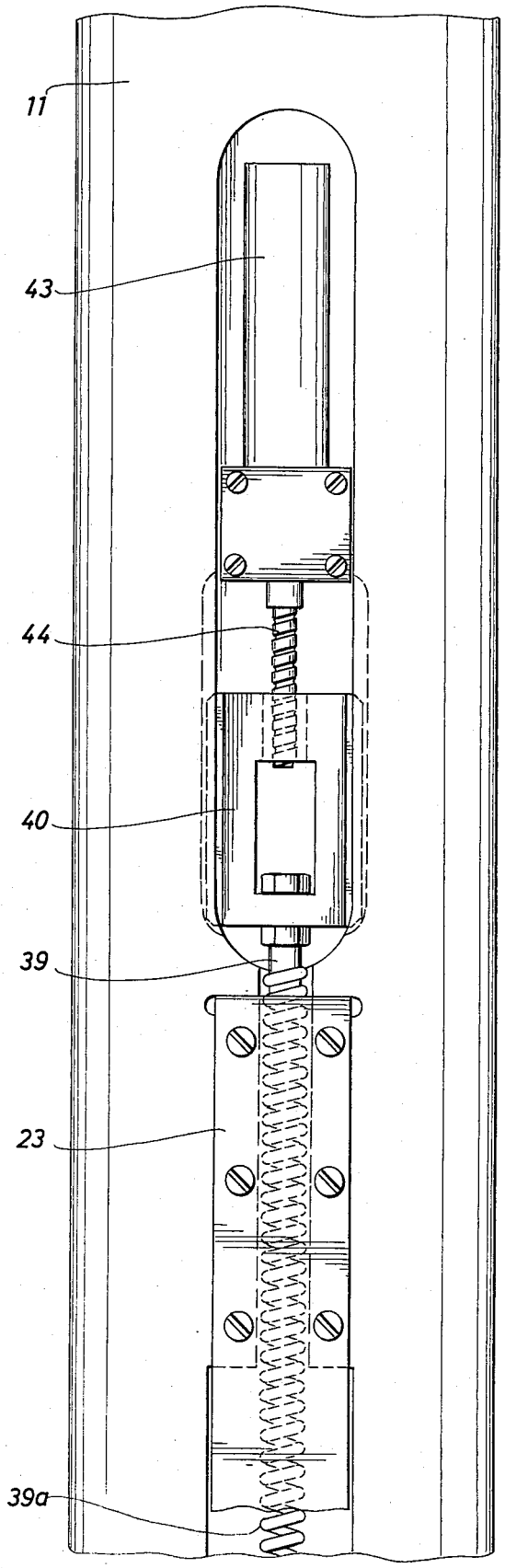
FIG. 4 is a transverse vertical section of the system shown in FIG. 3A.
Figure 5:
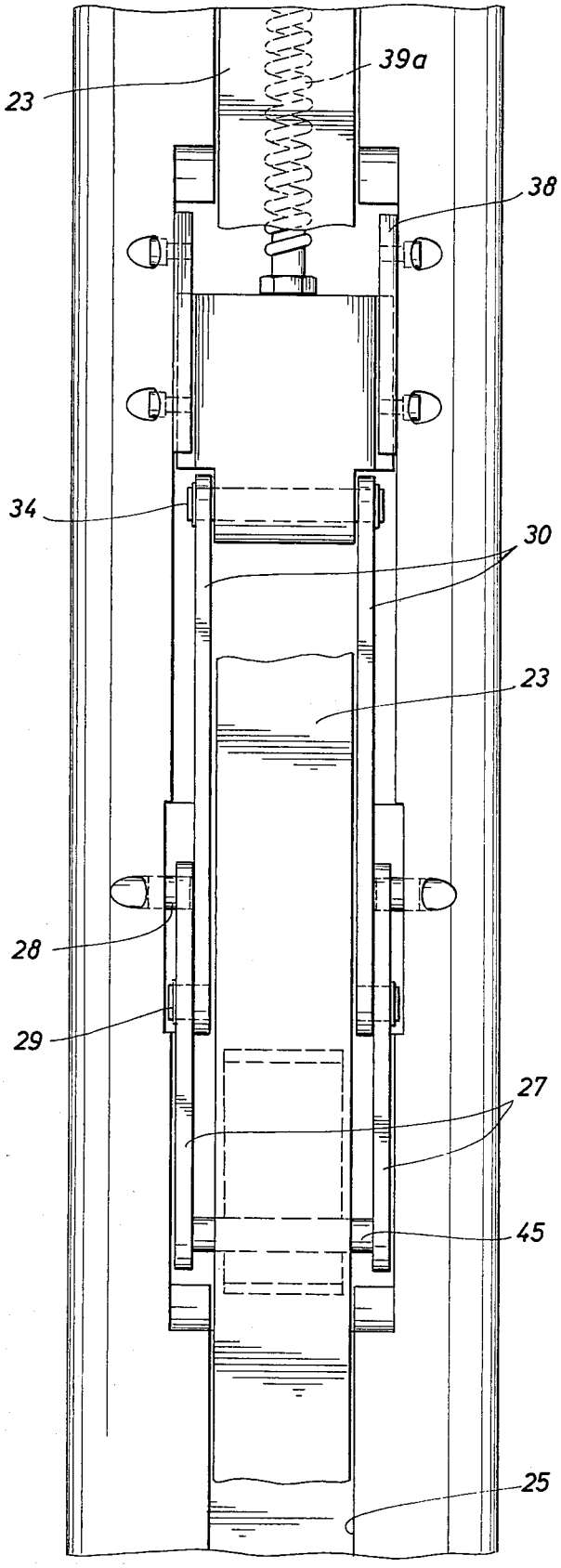
FIG. 5 is a transverse vertical section of the system shown in FIG. 3B.

FIGS. 3A and 3B show a preferred arrangement of an electrically-responsive means for moving a magnitude-responsive transducer such as transducer 22. As best seen in FIG. 8, the transducer-supporting arm 23 is a flat bar attached to a portion of the pipe wall of instrument sub 11. Such an arm is preferably constructed of a suitable spring material formed so that it is biased to hold the arm within a groove, such as groove 25, within the external confines of a drilling string assembly. The present invention is, at least in part, premised on the discovery that such a transducer-supporting arm can be biased to move inwardly with sufficient force to keep the transducer within the external confines of the drill string and yet can feasibly be forced outward to move the transducer into close proximity with the borehole wall by an electrically-actuatable moving means that can be mounted within the wall of an instrument-containing sub, such as sub 11. As will be apparent to those skilled in the art, other shapes can be similarly utilized for the transducer-supporting arm 23 and also the transducer-confining groove 25. Similarly, such transducer-supporting means can be biased to return within such grooves by means of springs or the like.

The transducer-supporting arm 23 is outwardly extended by deflection arms 27 which are pivotally mounted on pins 28 mounted in the wall of the instrument sub 11 (see FIG. 10) and pins 29. The deflection-initiating arms 30 are connected by pins 34 to a lower travelling block 35, which is confined within groove 25 by guide blocks 38 mounted on the wall of that groove (see FIG. 9). The lower travelling block 35 is connected by rod 39 to an upper travelling block 40, which is confined in groove 25 by guide blocks 42 (see FIG. 7). As shown in FIGS. 7 and 9, the lower and upper travelling blocks 35 and 40 are preferably provided with reliefs or channels 35*a* and 40*a* on the sides adjacent to the interior of channel 25; i.e, the inside surfaces, to minimize the areas of contact. Where this is done, the presence of mud and/or corrosion is less likely to cause any binding or jamming of the travelling blocks. The upper travelling block 40 is driven by an electric motor 43 arranged to turn a helical drive gear 44 to the right or left in response to an electrical signal.

The mechanical connection such as rod 39 between a motion-imparting means such as motor 43 and a movably-mounted transducer such as transducer 22 is preferably provided with a resilient linking-means such as spring 39*a*. The dimensions and stiffness characteristics of such a resilient-linking means are important. For example, assume that the resilient-linking means is a spring which is mechanically connected between a motor and a transducer which are contained within a longitudinally extensive groove along the exterior of a drill pipe section which is suitable for incorporation within a drill string containing 6 to 8-inch drill collars. Such a spring may be composed of 3/16-inch wire, have closed or near-closed coils of $\frac{3}{4}$-inch outer diameter with about 20 active coils, and have a stiffness of about 450 pounds per inch. Such a spring can be threaded onto ends of the rod 39 with the active section being about 4 inches long. As will be apparent to those skilled in the art, in the design of a such a system, several items should be considered. When the transducer is in its fully extended position, the spring should stretch far enough to allow the transducer-mounting linkage to be fully pushed back (e.g., by the wall of the borehole) into the slot 25. Thus, the maximum spring stretch should be at least equal to the maximum motor stroke required for the full extension of the transducer. The spring force generated by such a maximum stretch of the spring should not exceed the force-capacity of the motion-imparting motor. Otherwise, for example, where motor 43 has raised the upper travelling block 40 and upper end of spring 39*a* far enough to fully extend the transducer supporting arm 23 and the borehole wall has pushed the arm 23 back into the slot 25, the spring force applied to the motor (through helical gear 44) would keep the motor from turning and, if the drill string were then lowered or rotated, the transducer-mounting arrangement would be damaged. A resilient means such as spring 39*a* and the linkage below it (such as the travelling block deflection arms, etc.) form a spring-mass system that should be designed to have a natural resonance frequency distinctly different from the rotational frequency of the drill string. For example, by being five or more times greater than the rotational frequency, in order to avoid a resonating vibration that might cause the arms to become extended and destroyed while the drill string was being rotated to drill the borehole. The spring 39*a* can be replaced by side-by-side springs or by a spring of square or rectangular wire or the like; alternatively, the linkages can be arranged to extend the transducer in response to a pushing rather than a pulling motion, so that the resilient linking-means can be resilient in respect to compression rather than extension, etc. The stud ends of rod 39 can be extended into the coils of the spring 39*a* far enough to keep the spring from buckling when it is compressed. This extension must be a reduced diameter section so as not to interfere with the spring action. The spring and the transducer-mounting arm 23 are preferably arranged so that when the arm 23 moves into the slot 25, the spring is slightly compressed. This pushes the deflecting arms 27 against the lower portion of the confining loop 48 and applies a compression force which helps to push the arm 23, snugly against the interior of the slot 25.

As shown in FIG. 6, when the motor 43 is operated to move the upper travelling block 40 toward the motor, the upward and outward motion of the deflection-initiating arms 30 and the deflecting arms 27 cause the deflecting pin 45 to move upward and outward along the inner side of the transducer supporting arm 23 and outward toward the wall of the borehole. The deflecting pin is kept in close proximity to the transducer mounting arm 23 by the pin-confining loop 48.

In a particularly preferred arrangement the instrument sub 11 can be equipped with four transducer housing grooves 25 which are each provided with an electrical motor 43 arranged for moving transducers 22 so transducer wear pads 22*a* are pushed against the wall of the borehole far enough so that the flexible arms are bent and a resilient wall-contacting force is applied. The motors are preferably connected to operate simultaneously in response to each electrical command signal. By utilizing servo-mechanism, or by counting a selected number of revolutions of a drive gear, or the like, the motor 43, or an equivalent motion-imparting means, can be actuated to accurately position a transducer and/or a plastic wear pad 22*a* (see FIG. 2) so it is pushed against the borehole wall with a selected amount of force. After the transducers have been so extended, the drill string is raised through a portion of the borehole while energizing the transmitters and recording the received signals. After the interval of interest has been logged, the transducers are again retracted. If desired, the drill string is lowered and drilling is resumed.

Figure 11:
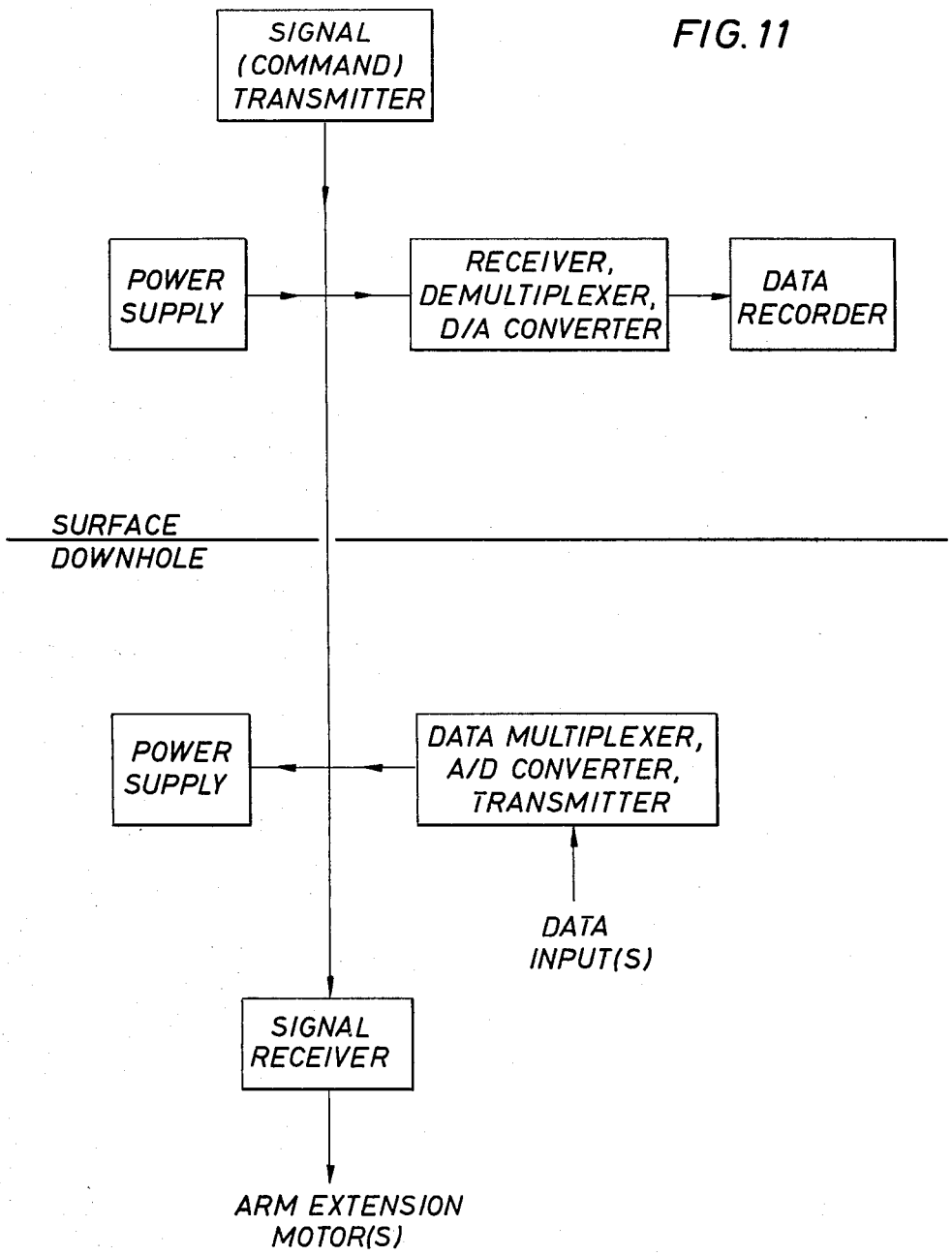
FIG. 11 is a block diagram of the electronics for an operating logging system of the present type.

FIG. 11 is a block diagram showing an arrangement of currently known and available electronic components which can be used in operating the present invention with a drill string along which electric or electromagnetic signals can be transmitted.

As will be apparent to those skilled in the art, the above procedures and methods (or procedures and methods which are substantially equivalent) can be utilized to provide borehole wall-contacting logging operations substantially as soon as a borehole is drilled. Logging systems which require or make it desirable to hold a transducer against, or in close proximity with, the wall of a borehole include caliper logs, compensated density logs, electromagnetic propagation logs, microlateral logs, dipmeter logs, sidewall sonic logs, and circumferential microsonic logs.

Use of the present method and apparatus is uniquely advantageous in drilling into a subterranean interval in which it is important to obtain information on one or more properties as soon as possible and/or to log the borehole without removing the drill string for a special logging run. In the present process, by stopping the drilling and logging every few feet, a log can be obtained substantially as soon as each short interval is drilled. By extending and retracting the transducers, the accuracy provided by keeping the transducers in contact with, or close to, the rocks around the borehole is provided without risking the damaging of the transducers or their mountings or the sticking of the drill string.

What is claimed is:

1. A process for drilling and logging a downwardly extending well borehole comprising:

drilling the borehole with a signal transmissive drill string which contains a magnitude-responsive transducer which, during the drilling, is kept at least substantially within the external confines of the drill string;

movably-mounting said transducer within a lower portion of the drill string and mechanically connecting it to a motion-imparting means which is capable of being actuated by a command signal transmitted along the drill string to urge the transducer toward or away from an extended position at least substantially in contact with the wall of a borehole drilled by the drill string or a retracted position at least substantially within the exterior confines of the drill string;

stopping the drill string and transmitting along it a command signal that initiates the urging of the magnitude-responsive transducer toward its extended position;

raising the drill string while transmitting along it a signal indicative of the magnitude at which a subterranean physical or chemical property is encountered by the magnitude-responsive transducer while it is in contact with, or in close proximity to, the borehole wall;

operating a movement-responsive transducer to provide a signal indicative of the distance by which the drill string is raised;

providing a record of the variation with depth in said subterranean property; and, stopping the drill string and transmitting along it a command signal that initiates the urging of the magnitude-responsive transducer toward its retracted position.

2. The process of claim 1 in which:

the magnitude-responsive transducer is mechanically connected to the motion-imparting means by a resilient linking-means;

the motion-imparting means is operated to move one portion of the resilient linking-means by a distance sufficient to press the transducer against one side of the borehole when the drill string is pressed against the opposite side; and, the resilient linking-means is arranged so that, in response to said movement, the force transmitted to the transducer is sufficient to move the transducer, when its movement is not prevented by the borehole wall, but is insufficient to move or damage the transducer or the means by which it is moved or mounted when the transducer-containing portion of the drill string is pressed against the wall of the borehole.

3. The process of claim 1 in which:

an inward biasing force is applied to continually urge the transducer toward its retracted position; and, the force provided by the motion-imparting means urges the transducer toward its extended position by overriding the biasing force.

4. The process of claim 1 in which the borehole is drilled by rotating the drill string to drill about the length of the pipe section, stopping it to add a new pipe section, then resuming the drilling operation, and the initiating of the steps of urging of the magnitude-responsive transducer toward its extended position, raising the drill string while logging, and urging the transducer toward its retracted position, are initiated at a time at which the addition of a section of drill string is desirable.

5. The process of claim 1 in which electrical command and magnitude-responsive data signals are transmitted along the lower portion of the signal-transmissive drill string by means of a remotely connectable wire line and are transmitted along the upper portion of that drill string by means of an insulated electrical conductor that extends through and across the joints of a series of interconnected drill pipe sections.

6. A well logging instrument-containing drill collar section which is capable of being incorporated into a signal-transmissive drill string containing a plurality of drill pipe and collar sections, comprising:

a drill collar section which contains an internal fluid passageway and at least one groove extending longitudinally along the exterior of the section;

within said groove, a movably-mounted magnitude-responsive transducer which is mechanically connected to a motion-imparting means which is capable of being actuated by command signal transmitted along the drill string to urge the transducer toward or away from an extended position at least substantially in contact with the wall of the borehole drilled by the drill string or a retracted position at least substantially within the external confines of the drill string;

within said drill collar section, a signal-transmissive means for transmitting to the motion-imparting means the signals from a means for transmitting along the drill string a command signal for initiating the urging of the magnitude-responsive transducer toward its extended position; and within said drill collar section, a signal-transmissive means for transmitting along the drill string a signal indicative of the magnitude of a subterranean property encountered by the magnitude-responsive transducer.

7. The apparatus of claim 6 in which:

the magnitude-responsive transducer is mechanically connected to the motion-imparting means by a resilient linking-means;

the motion-imparting means is arranged to move one portion of the resilient linking-means by a distance sufficient to press the transducer against one side of said borehole wall while the drill string is pressed against the opposite side;

the resilient linking-means is arranged so that, in response to said movement, the force transmitted to the transducer is sufficient to move the transducer when movement is not prevented by the proximity of the borehole wall, but is insufficient to move or damage the transducer, or the means by which it is moved or mounted, when the transducer-containing portion of the drill string is pressed against the wall of the borehole.

8. The drill collar section of claim 7 in which:

said motion-imparting means is arranged to apply an extending motion to the resilient linkage-means; and the resilient linking-means consists essentially of an extendable spring.

9. The drill collar section of claim 6 in which:

the magnitude-responsive transducer is mounted on a resilient member on which a biasing force is applied in a direction tending to urge the transducer toward its retracted position; and, the motion-imparting means is arranged to move the transducer toward its extended position by overriding said biasing force.

10. The drill collar section of claim 6 in which:

said drill collar section contains an electrical conductor capable of being remotely connected to a wire line; and, said signal-transmissive drill string is arranged for the transmission of electrical command and magnitude-responsive data signals along its lower portion by means of a remotely connectable wire line and the transmission of such signals along its upper portion by means of a segmented insulated electrical conductor extending along each of a series of electrical conductor-containing drill pipe sections.

* * * * *